US006283253B1

(12) United States Patent
Folli et al.

(10) Patent No.: US 6,283,253 B1
(45) Date of Patent: Sep. 4, 2001

(54) FASTENING SYSTEM FOR SHAFT INFORMATION TRANSMITTERS OF A LIFT INSTALLATION

(75) Inventors: Stefano Folli, Locarno; Alain Scherrer, Locarno-Monti; Paolo Milimatti, Minusio, all of (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/395,908

(22) Filed: Sep. 14, 1999

(30) Foreign Application Priority Data

Sep. 14, 1998 (EP) ..... 98 810910

(51) Int. Cl.[7] ..... B66B 3/02
(52) U.S. Cl. ..... 187/394; 187/391; 187/414
(58) Field of Search ..... 187/391, 394, 187/414, 282, 283, 277

(56) References Cited

U.S. PATENT DOCUMENTS

| | | | | |
|---|---|---|---|---|
| 2,840,188 | * | 6/1958 | Savage | 187/391 |
| 2,938,603 | | 5/1960 | Loughridge | 187/394 |
| 3,674,113 | * | 7/1972 | Richmon | 187/29 R |
| 3,765,510 | * | 10/1973 | Richmon | 187/29 R |
| 4,203,506 | | 5/1980 | Richmon | 187/394 |
| 4,433,756 | * | 2/1984 | Caputo et al. | 187/29 R |
| 5,783,783 | * | 7/1998 | Toutaoui et al. | 187/394 |
| 5,798,490 | | 8/1998 | Vairio et al. | 187/394 |
| 5,893,433 | * | 4/1999 | Koura | 187/394 |

FOREIGN PATENT DOCUMENTS

| | | | | |
|---|---|---|---|---|
| 353093547 | * | 8/1978 | (JP) | 187/394 |
| 54-122546 | * | 9/1979 | (JP) | 187/394 |

* cited by examiner

*Primary Examiner*—Jonathan Salata
(74) *Attorney, Agent, or Firm*—Schweitzer Cornman Gross & Bondell LLP

(57) ABSTRACT

A fastening system for lift shaft information transmitters includes multiple carriers to support shaft information transmitters in different height positions for each story upon cables stretched over the entire height of the shaft. A respective bracket arranged at a guide rail may be provided at each of the lower and upper shaft ends. Tension springs, which are connected at one end each with a respective shackle, are connected at cable thimbles of the lower cable ends. The cable can be prestressed by the shackle arranged at the lower bracket. In an illustrative embodiment, three cables are provided, wherein the middle cable is slightly displaced relative to the outer cables towards the rear in the depth of the shaft and the outer cables are slightly displaced inwardly in the width of the carrier. For larger lift installations, a retaining rail, which is arranged at the guide rail and by means of which the cables are held fast, may be provided for each three to four storys. The retaining rail damps cable oscillations.

6 Claims, 3 Drawing Sheets

FASTENING SYSTEM FOR SHAFT INFORMATION TRANSMITTERS OF A LIFT INSTALLATION

The invention concerns a fastening system for shaft information transmitters of a lift installation comprising cables which are stretched over the height of the shaft and at which the shaft information transmitters provided for the production of shaft information are arranged, wherein the shaft information is produced by means of the shaft information transmitters, and a sensor unit arranged at a lift cage.

BACKGROUND OF THE INVENTION

A lift shaft with non-magnetic cables, which are stretched over the height of the shaft and upon which magnetizable segments or wrappings are arranged, has become known from U.S. Pat. No. 4,203,506. At least one segment is provided for each storey. Sensors for the scanning of the magnetizable segments are provided at the lift cage, which is movable in the lift shaft. The signals of the sensors are used for the production of control signals for the lift cage.

A disadvantage of the known equipment is that expensive non-magnetic cables are necessary to support the magnetizable segments. In addition, once the magnetizable segments are oriented and mounted on the cables they are no longer displaceable or repositionable. Furthermore, additional segments are mountable only with great effort.

BRIEF DESCRIPTION OF THE INVENTION

The present invention provides a remedy to such shortcoming. The invention creates a fastening system, by means of which shaft information transmitters are mountable without great effort and accurately positionable at any time.

The present invention comprises a carrier which is mounted to cables which extend the length of the lift shaft. A plurality of information transmitters are affixed to the carrier. The positioning of the transmitters on the carrier is adjustable, and the transmitters may be affixed to the carrier before the carrier is mounted to the cables. The carrier is mounted to the cable by a slot arrangement which maintains the carrier in a chosen position but still allows the carrier to be re-positioned as may be required. The advantages achieved by the invention include large savings in assembly time. The shaft information transmitters of a lift installation with, for example, five storeys can be mounted in at most two hours. It is furthermore of advantage that all shaft information transmitters associated with a particular shaft position are displaceable and re-positionable at the same time without changing the relative positionings of the shaft information transmitters with respect to each other. It is furthermore advantageous that the shaft information transmitters can he preassembled upon the carrier at the factory, allowing the shaft information transmitters for a particular shaft position to be positioned accurately relative to each other. Thus, only the carrier need be arranged at the corresponding shaft height at the proper location.

BRIEF DESCRIPTION OF THE DRAWINGS

The invention is explained more closely in the following by reference to drawings which illustrate an illustrative embodiment and in which.

DETAILED DESCRIPTION OF THE INVENTION

Figure 1:
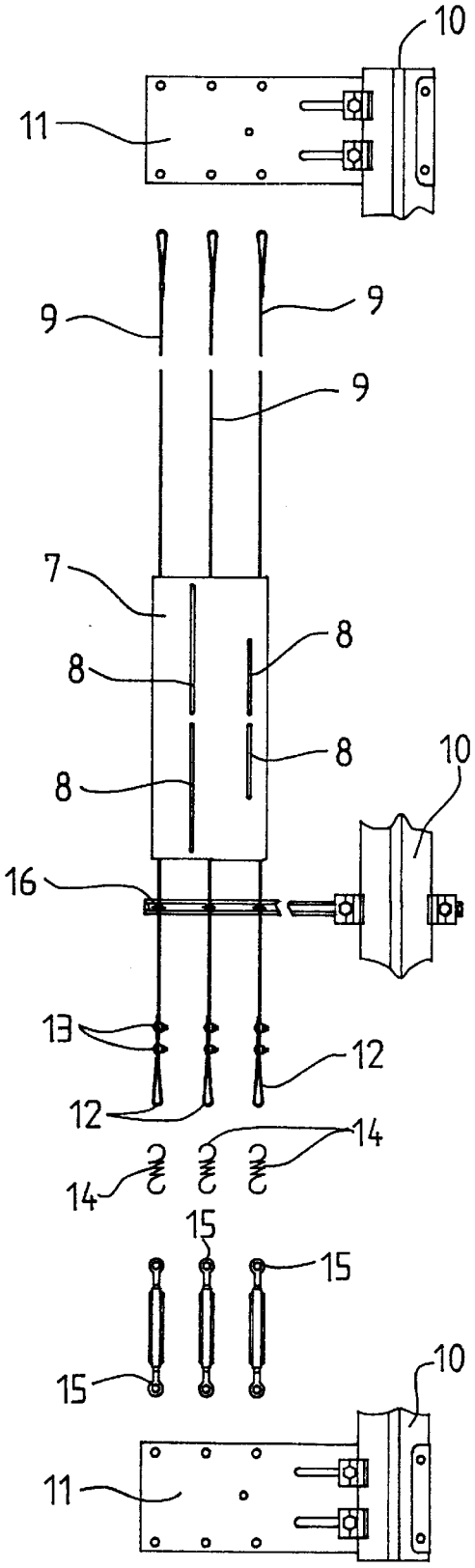
FIG. 1 is an exploded view of a fastening system for shaft information transmitters of a lift installation in accordance with the invention.

A lift cage movable in a lift shaft 2 is denoted by 1 in the Figures A sensor unit 3, by means of which the position of shaft information transmitters 4 arranged in the lift shaft 2 is detectable, is mounted to the lift cage 1. Each transmitter 4 is mounted to a carrier 7, such as by means of a bolt 5 and a nut 6 at the longitudinal slots 8 in the carrier. For each storey, two to three carriers 7 are arranged in different height positions on cables 9 which are stretched and extend over the entire height of the lift shaft. In the illustrated embodiment, three cables 9 are shown and utilized. Two, or more than three, cables 9 can alternatively be provided. A respective bracket 11 arranged at a shaft guide rail 10 which extends the length of the shaft is provided at each of the lower and the upper ends of the shaft. The ends of the cables 9 may be formed into cable thimbles 12 by means of cable clamps 13. The cable thimbles 12 of the upper cable ends are connected directly to the upper bracket 11. Tension springs 14, which are each connected at one end to a respective shackle or turnbuckle 15, engage the cable thimbles 12 of the lower cable ends. The cables 9 can be prestressed by the shackles 15 arranged at the lower bracket 11.

Figure 2:
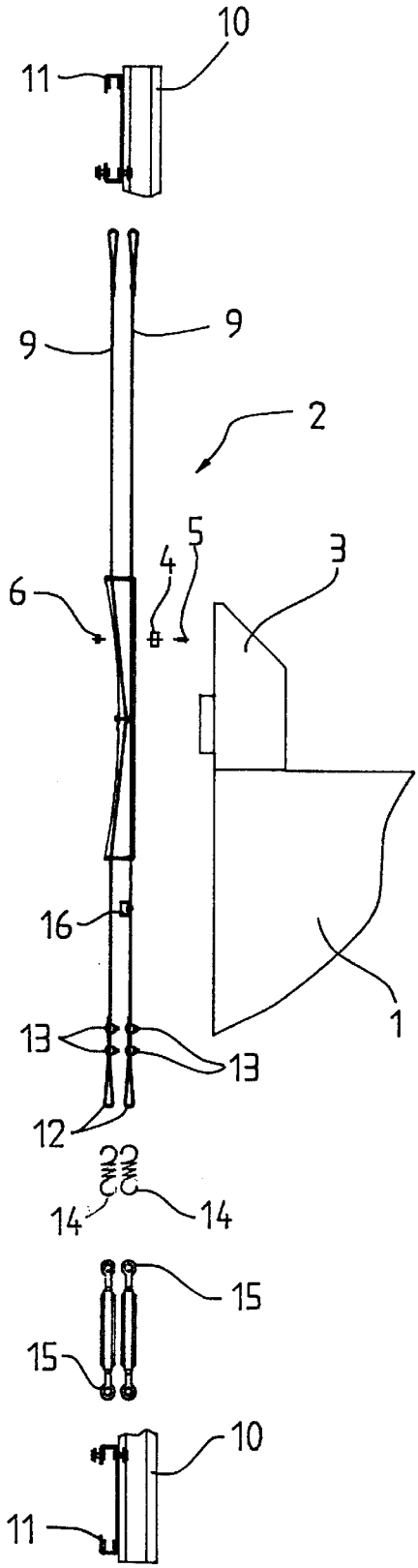
FIG. 2 is a side elevation view of the fastening system.

In the illustrated embodiment the three cables are provided. The clamping system on the carrier displaces the middle cable 9 relative to the outer cables 9 slightly to the rear in the depth of the shaft, as seen in FIG. 2, while the outer cables 9 are slightly displaced inwardly from the side edges of the carrier 7, as seen in FIG. 1. Such displacement maintains the carrier in position but still permits the carrier to be moved along the cables if required for re-positioning. For larger lift installations, a retaining rail 16, which is mounted to the guide rail 10 and by means of which the cables 9 are held fast, may be provided for each three to four storeys of shaft run. The retaining rails 16 damps cable oscillations and in particular oscillations, which may be initiated manually during assembly. Such oscillations are normally minimal during operating movement of the lift cage 1 in the lift shaft 2.

Figure 3:
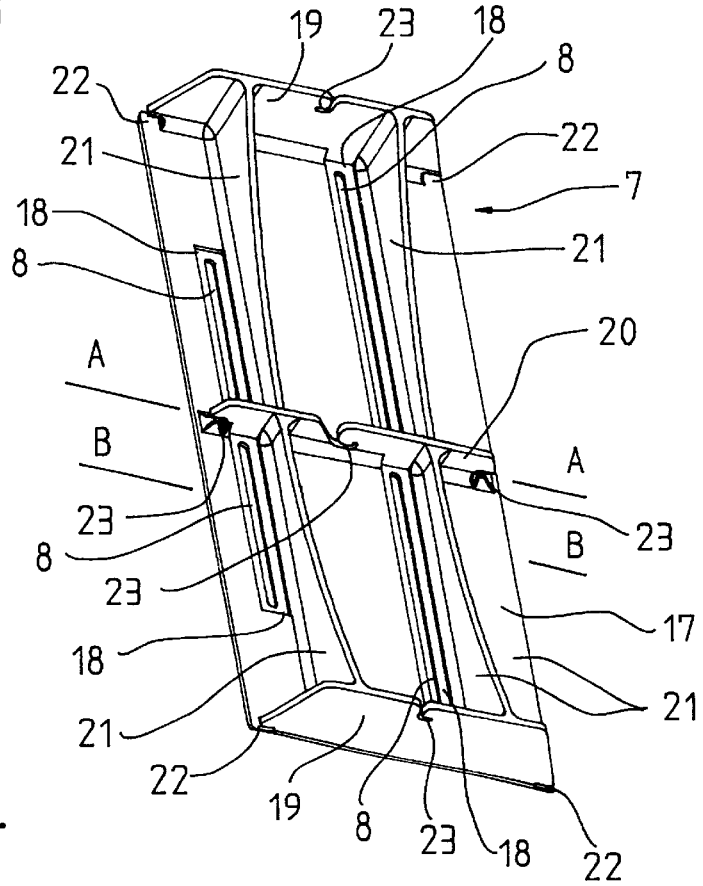
FIG. 3 is a perspective view of a carrier for the shaft information transmitters.
Figure 4:
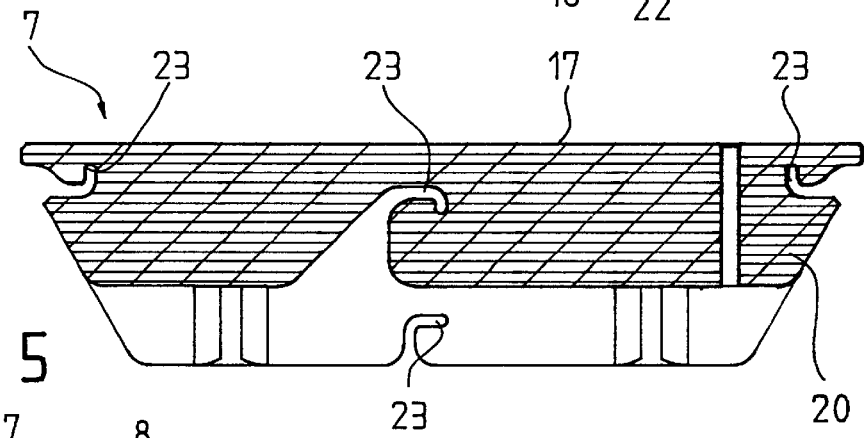
FIG. 4 is a sectional view taken along the line A—A of FIG. 3.
Figure 5:
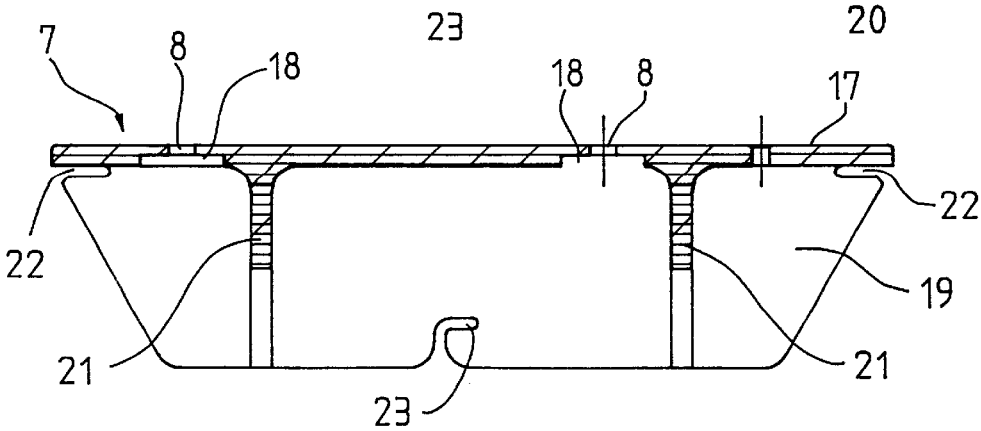
FIG. 5 is a section view taken along the line B—B of FIG. 3.

FIG. 3 shows the carrier 7 as seen from the rear side as in a three-dimensional perspective illustration. The carrier 7 consists of a carrier plate 17 with longitudinal slots 8 through which the mounting bolts for the information transmitters extend. The slots are surrounded by grooves or depressions 18 on the rear face of the carrier plate to accommodate the bolt nuts. An end web 19 extends transversely along each narrow side of the carrier plate, while middle web 20 runs parallel thereto. The end webs 19 are formed to be somewhat higher than the middle web 20. The webs 19 and 20 are connected by means of longitudinally extending spaced ribs 21. As further detailed in FIGS. 4 and 5, the end webs 19 have guide slots 22 at each corner facing the carrier plate. A hooked clamping slot 23 is arranged centrally at the outer edge of each of the end webs 19, wherein the direction of one clamping slot 23 is opposite to the direction of the other clamping slot 23. Three hooked clamping slots 23, corresponding to and generally aligned with the guide slots 22 and clamping slots 23 of the outer webs 19, are arranged at the middle web 20. The position of the clamping slots 23 of the middle web 20 together with the position of the slots 22 and 23 of the end webs 19 forms a cable guide and retainer, as shown in FIG. 7.

Figure 6:
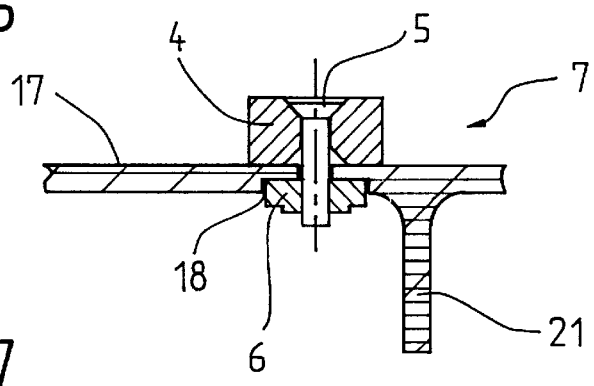
FIG. 6 is a sectional view of a shaft information transmitter mounted upon a carrier.

FIG. 6 shows a shaft information transmitter 4, which is mounted to the carrier plate 17 by means of the bolt 5 in a slot 8 and the nut 6 guided in the corresponding groove 18. The illustrated shaft information transmitter 4 may be, for example, a magnet which changes the switching state of a magnetic proximity switch of the sensor unit 3 when the lift cage 1 travels past the transmitter to produce a shaft position information signal. Through the switching state of the magnetic switch, the lift control can determine the position of the lift cage 1 in the lift shaft 2 and can, for example, approximately control the drive. Other transmitters, operating for example on an inductive or capacitive principle with the appropriate associated sensors, can also be used. The magnets 4 may be mounted correctly in position on the carrier in the factory, utilizing the slots 8. On location, with the transmitters correctly oriented on the carrier, the middle cable 9 is clamped correctly in position in the middle clamping slots 23 of the carrier 7. Thereafter, the outer cables 9 are clamped in the corresponding clamping slots 23 and laid into the corresponding guide slots 22. Displacement of the cables as they pass through the slots allow the carrier 7 to be retained firmly in position by the cables 9. With a certain force effort, the carrier 7 can, however, be displaced upwardly or downwardly along the cables 9 as may be required for adjustment or re-positioning purposes.

Figure 7:
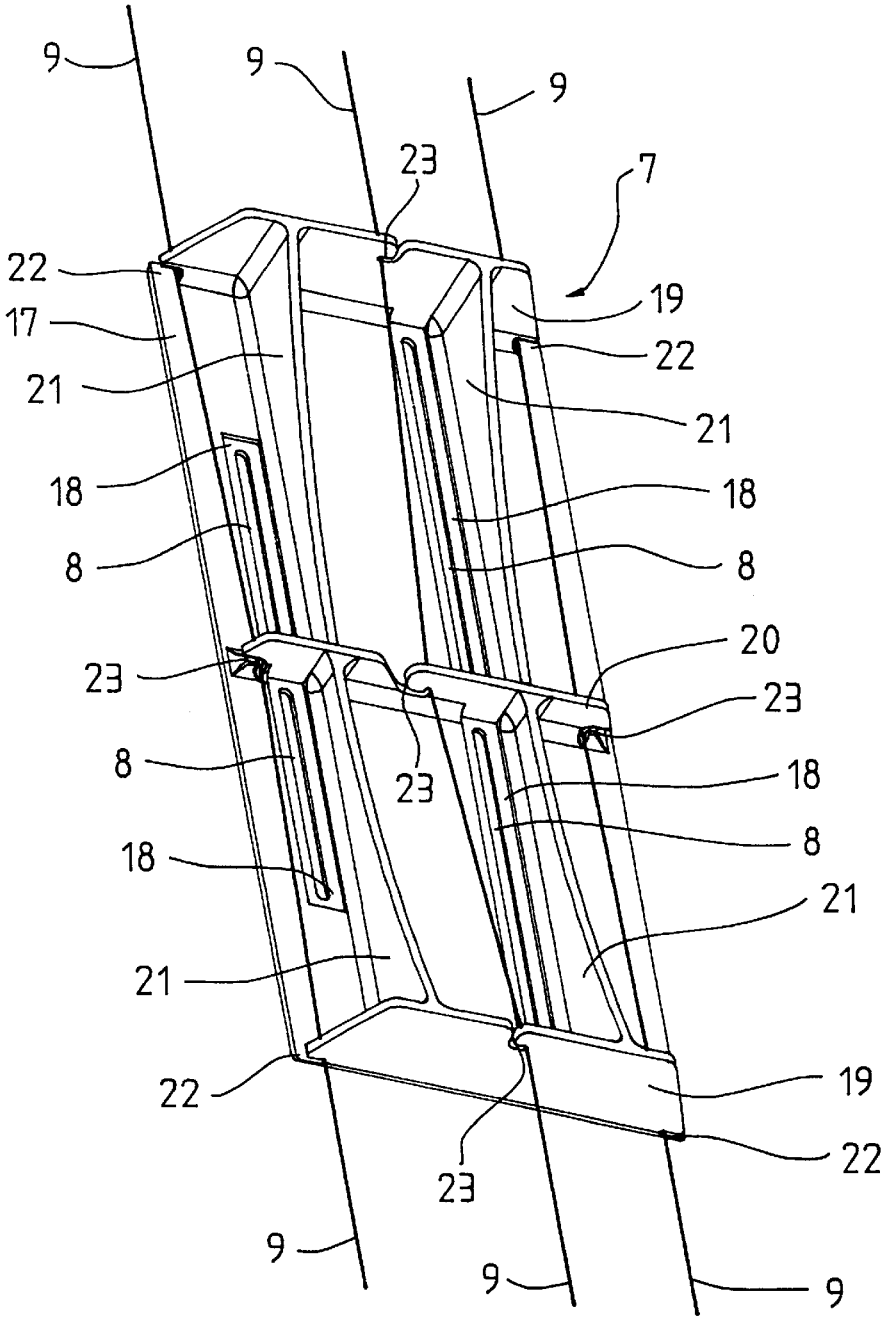
FIG. 7 is a perspective view of the carrier mounted upon the cables.

FIG. 7 shows the cable guide after installation of the carrier 7. The middle cable is deflected to the front of the carrier from the clamping slots of the end webs 19 by the central clamping slot 23 of the middle web 20, and the outer cables 9 are slightly deflected inwardly from the guide slots 22 of the end webs by the outer clamping slots 23 of the middle web 20. The carrier 7 is both stiffened and fixed in place along the cables by the illustrated cable guide and clamping slot orientation.

We claim:

1. A fastening system for shaft information transmitters of a lift installation having at least two cables which extend the height of a lift shaft and at which the shaft information transmitters are located, and a sensor unit arranged at a lift cage, comprising at least one carrier for at least one shaft information transmitter of a unitary construction and having means for the engagement of at least two of the cables for selective frictional positioning of the carrier at a selected location along the cables; maintaining proper orientation of the shaft information transmitter with respect a car sensor unit, and for the sliding repositioning of the carrier along the length of the cables without additional clamping or fastening elements, the carrier having means to support at least one shaft information transmitter proximate to, but in a non-contact relationship with, the car sensor unit.

2. The fastening system according to claim 1, characterized in that the carrier comprises at least one web upon which slots for at least one of clamping and guiding the cables are provided.

3. The fastening system according to claim 2, characterized in that the carrier has at least one longitudinal slot for the displaceable arrangement of at least one shaft information transmitter.

4. The fastening system according to claim 2, characterized in that ribs extending between the webs are provided for stiffening the carrier.

5. The fastening system according to claim 1, 2, 3 or 4, further characterized in that at least one bracket is arranged at a shaft guide rail for the fastening of ends of the cables, wherein tensioning means are provided at at least one bracket for tensioning the cables.

6. The fastening system according to claim 5 further characterized in that retaining rail means for the avoidance of cable oscillations are arranged at the guide rail.

* * * * *